US010100630B2

(12) United States Patent
Bartel et al.

(10) Patent No.: US 10,100,630 B2
(45) Date of Patent: Oct. 16, 2018

(54) METHOD AND APPARATUS FOR COMMUNICATING INCREMENTAL DEPTH AND/OR OTHER USEFUL DATA OF A DOWNHOLE TOOL

(71) Applicant: Weatherford Technology Holdings, LLC, Houston, TX (US)

(72) Inventors: Roger P. Bartel, Spring, TX (US); Charles Lee Mauldin, Spring, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 739 days.

(21) Appl. No.: 14/621,007

(22) Filed: Feb. 12, 2015

(65) Prior Publication Data

US 2015/0226050 A1 Aug. 13, 2015

Related U.S. Application Data

(60) Provisional application No. 61/938,870, filed on Feb. 12, 2014.

(51) Int. Cl.

| | |
|---|---|
| ***E21B 47/04*** | (2012.01) |
| ***E21B 45/00*** | (2006.01) |
| ***E21B 47/12*** | (2012.01) |
| ***E21B 47/18*** | (2012.01) |

(52) U.S. Cl.

CPC ..... *E21B 47/04* (2013.01); *E21B 45/00* (2013.01); *E21B 47/124* (2013.01); *E21B 47/18* (2013.01)

(58) Field of Classification Search

CPC ..... E21B 47/04; E21B 47/12; E21B 47/124

See application file for complete search history.

(56) References Cited

U.S. PATENT DOCUMENTS

| | | | | |
|---|---|---|---|---|
| 4,763,258 | A | 8/1988 | Engelder | |
| 4,875,530 | A | 10/1989 | Frink et al. | |
| 4,976,143 | A | 12/1990 | Casso | |
| 5,139,094 | A | 8/1992 | Prevedel et al. | |
| 5,274,552 | A * | 12/1993 | Milburn | E21B 47/04 702/9 |
| 6,244,361 | B1 | 6/2001 | Comeau et al. | |
| 6,267,185 | B1 | 7/2001 | Mougel et al. | |

(Continued)

FOREIGN PATENT DOCUMENTS

| | | |
|---|---|---|
| EP | 0443689 B1 | 7/1994 |
| EP | 2169176 A2 | 3/2010 |

(Continued)

OTHER PUBLICATIONS

Lines, et al., "Advance Drilling Dynamics Sensor Allows Real-Time Drilling Optimization, Damage Prevention and Condition Monitoring of RSS and LWD BHAs," SPE-170586-MS, dated Oct. 27, 2014.

(Continued)

*Primary Examiner* — D. Andrews
(74) *Attorney, Agent, or Firm* — Blank Rome, LLP

(57) ABSTRACT

A method and apparatus for communicating incremental depth and/or other useful data of a downhole tool. The incremental depth and/or other useful data of the downhole tool being communicated by measuring at least one change in the downhole system, detecting the change downhole, and subsequently determining the incremental depth and/or other useful data of the downhole tool.

25 Claims, 4 Drawing Sheets

(56) References Cited

U.S. PATENT DOCUMENTS

| | | | | |
|---|---|---|---|---|
| 6,647,637 | B2 | 11/2003 | Lechen | |
| 7,100,708 | B2 | 9/2006 | Koedertiz | |
| 8,417,456 | B2 | 4/2013 | Maulden et al. | |
| 2006/0102389 | A1* | 5/2006 | Wiseman | E21B 10/46 175/57 |
| 2008/0000688 | A1* | 1/2008 | McLoughlin | E21B 44/00 175/40 |
| 2011/0147083 | A1 | 6/2011 | Mauldin et al. | |
| 2013/0092439 | A1 | 4/2013 | Mauldin et al. | |

FOREIGN PATENT DOCUMENTS

| | | | |
|---|---|---|---|
| GB | 2432176 | A | 5/2007 |
| WO | 2009/039448 | A2 | 3/2009 |
| WO | 2013/056152 | A1 | 4/2013 |

OTHER PUBLICATIONS

Partial European Search Report in counterpart EP Appl. EP 15154919, dated Mar. 16, 2016.

Notice of Allowance in counterpart Canadian Appl. 2,881,918, dated Mar. 16, 2016.

* cited by examiner

METHOD AND APPARATUS FOR COMMUNICATING INCREMENTAL DEPTH AND/OR OTHER USEFUL DATA OF A DOWNHOLE TOOL

CROSS-REFERENCE TO RELATED APPLICATIONS

This application claims the benefit of U.S. Prov. Appl. 61/938,870, filed 12 Feb. 2014, which is incorporated herein by reference.

BACKGROUND

Downhole drilling for oil and gas typically involves an operator drilling a well by rotating a drillstring having a drill bit attached, and using the system to bore through a formation. In a common form of drilling called rotary drilling, a rotary table or a top drive rotates the drillstring. A bottom hole assembly (BHA) on the drillstring has increased weight and provides necessary force on the assembly's drill bit to optimize the rate of penetration (ROP) of the system while drilling through the formation, thereby increasing drilling efficiency.

In measurement while drilling (MWD) applications, downhole sensors are disposed along the body of the drillstring and are used for measuring geophysical properties of the surrounding wellbore during drilling operations. During MWD operations, it is also commonly desired for the operator to take periodic measurements downhole using the downhole sensors, at particular sampling rates (i.e., based on timing) per the distance drilled in the wellbore. However, these sampling rates may vary, requiring many measurements per drilled foot within the wellbore or requiring fewer measurements per drilled foot.

If the ROP of the drill bit changes, however, and if the downhole sensors are unable to change sampling rates based on the changed ROP, then the downhole sensors may take too few measurements (e.g., if the ROP increases to a rate faster than the sensors had been originally set to take measurements), or the sensors may take measurements too often (e.g., if the ROP decreases). Occasionally, the formation that the drill bit bores through downhole may be very dense, causing the ROP to decrease to the point that the sensors take redundant measurements (i.e., the sensors actually take multiple snapshots of the same data). Therefore, if the downhole sensors are unaware of the drilling depth or the rate that the drilling depth changes (i.e., the ROP), the sensors may take multiple, repetitive measurements unnecessarily downhole. This leads to needless power consumption and memory storage capacity issues downhole.

Different forms of data can be useful downhole during operations. For example, information related to time, depth, and/or ROP could be useful for operating the downhole sensors and other components of the downhole assembly. For example, other devices downhole, such as rotary steerable tools, directional drilling equipment, etc., can also benefit from different forms of information, such as incremental depth or real-time depth.

It is possible to transmit data downhole to the BHA by using pressure communication, electromagnetic communication, classical RPM communication, and other forms of known telemetry.

As one example, U.S. Pat. No. 4,763,258 discloses how information can be communicated to a microprocessor downhole via an inclinometer and magnetometer by selectively rotating a drillstring during a data time interval through a predetermined magnitude of angular displacement or angular velocity. In another example, U.S. Pat. No. 6,267,185 discloses how a drillstring can be rotated at surface sequentially through one or more discrete angles of rotation or at different angular rates to generate a command code. The sequence of discrete angular rotations or angular rates is sensed downhole by a gyroscope and decoded as a command in a microprocessor, which transmits the decoded command to controlled equipment.

The various telemetry techniques typically require special equipment, may be incapable of being performed while drilling a borehole, and may adversely affect operations. Depending upon the technique, for example, many of these solutions may be very cumbersome, may be manual in nature, and may require particular transmission windows of time for communicating encoded data. Due to these issues with known solutions in the art, as well as the slow rates of data transmission and the disruptive nature these solutions contribute to drilling operations, it is impractical to use these solutions to transmit useful data (e.g., time, depth, and/or ROP information) to the BHA.

It is therefore desirable to have a system and method for communicating the incremental depth and other useful data of a borehole tool to downhole sensors while remaining transparent to drilling operations. The subject matter of the present disclosure is directed to overcoming, or at least reducing the deficiencies of, one or more of the problems set forth above.

SUMMARY OF THE DISCLOSURE

A method and apparatus communicates incremental depth and/or other useful data of a downhole tool. The incremental depth and/or other useful data of the downhole tool is communicated by measuring at least one change in the downhole system, detecting the change downhole, and subsequently determining the incremental depth and/or other useful data of the downhole tool.

In one embodiment of a method for communicating incremental depth of a downhole tool, a downhole tool is provided having a drill collar disposed on a drillstring and having downhole control circuitry. At least one angular rate sensor is disposed on the drill collar and is communicatively coupled to the downhole control circuitry. A rotational drive is mechanically coupled to the drill collar, and a rotational drive controller is communicatively coupled to the rotational drive. The rotational drive controller and the downhole control circuitry are configured with a predetermined rate change and a predetermined depth change. An actual depth change of the drillstring is measured, and the rate of the drillstring is changed using the rotational drive when the actual depth change of the drillstring and the predetermined depth change of the drillstring are at least the same.

Using the at least one angular rate sensor, the rate change of the drillstring is detected, and the actual depth change of the drillstring is determined using the downhole control circuitry. The rotational drive can include one or more of a rotary table, a mud system, a mud motor, a downhole generator, a turbine, and an impeller. Additionally, a drawworks encoder can be used to measure the actual depth change of the drillstring.

In another embodiment of a method of drilling a borehole with a downhole assembly, at least one predetermined depth interval is stored in the downhole assembly. Changes from different rotational rates imparted to the downhole assembly are detected using an angular rate sensor of the downhole assembly. A downhole depth value for the downhole assembly is determined using processing circuitry of the downhole assembly based on the detected changes in the different rotational rates correlated to the at least one predetermined depth interval stored in the downhole assembly. An operation of the downhole assembly is controlled based on the determined depth value.

In an embodiment, a downhole assembly is used for drilling a borehole. The assembly includes a drilling component, storage, an angular rate sensor, and processing circuitry. The drilling component is disposed on the assembly and drills the borehole with rotation. The storage is disposed on the assembly and stores at least one predetermined depth interval. The angular rate sensor is disposed on the assembly and detects the rotation. The processing circuitry is disposed on the assembly and is operatively coupled to the storage and the angular rate sensor. The processing circuitry determines a downhole depth value of the downhole assembly based on successive changes detected in the rotation of the downhole assembly correlated to the at least one predetermined depth interval stored in the storage.

In an embodiment of a method of downlinking depth information from surface equipment to a downhole assembly used in drilling a borehole, at least one predetermined depth interval in the downhole assembly is stored. At least one angular rate sensor is configured on the downhole assembly to detect different rotational rates. The borehole is drilled with the downhole assembly by: advancing the downhole assembly in the borehole, measuring with the surface equipment successive ones of the at least one predetermined depth interval, and alternatingly imparting rotation to the downhole assembly with the different rotational rates for the successive ones of the at least one predetermined depth interval.

In an embodiment, a drilling system is used for downlinking depth information from a surface to a downhole assembly used in drilling a borehole. The system includes storage, a drive, surface equipment, and control circuitry. The storage stores at least one predetermined depth interval. The drive imparts rotation to the downhole assembly to drill the borehole, and the surface equipment advances the downhole assembly in the borehole and measures successive ones of at least one predetermined depth interval. The control circuitry is operatively coupled to the storage, the drive, and the surface equipment. The control circuitry alternatingly imparts the rotation to the downhole assembly with different rotational rates for the successive ones of the at least one predetermined depth interval.

The foregoing summary is not intended to summarize each potential embodiment or every aspect of the present disclosure.

DETAILED DESCRIPTION OF THE DISCLOSURE

Figure 1:
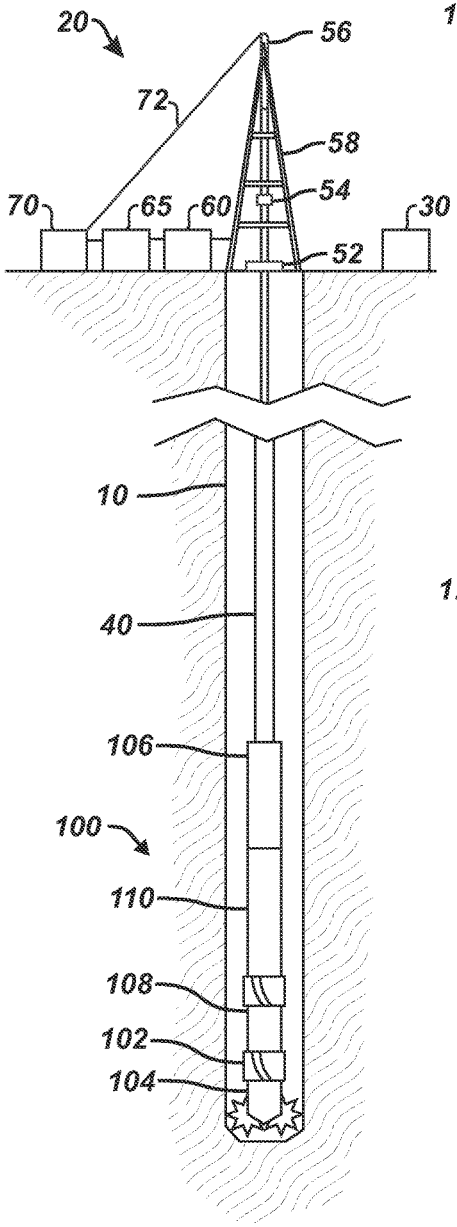
FIG. 1 illustrates a drilling system according to the present disclosure.

FIG. 1 illustrates a drilling system 20 drilling a borehole 10 penetrating an earth formation. The system 20 has a drilling assembly 100 (e.g., a bottom hole assembly) suspended from a drillstring 40. At the surface, a derrick structure 58 supports the drillstring 40 and has a crown block 56 at the top. A traveling block 54 moveably connected to the crown block 56 connects to the drillstring 40, and a drawworks control 70 releases or detracts a cable 72 to raise or lower the traveling block 54, which in turn raises or lowers the drillstring 40. Meanwhile, a rotary control 60 controls rotation of a rotary table 52, thereby rotating the drillstring 40, and surface equipment 30 having processing circuitry, memory, telemetry equipment, and the like can provide controls for the system 20.

The drilling assembly 100 includes one or more stabilizers 102, a drill bit 104, a drill collar 106, a monitoring tool 110, and other conventional components. The assembly 100 may also include components, such as a motor, a directional drilling tool 108 (e.g., a rotary steerable tool), or the like. During drilling operations, the rotary table 52 imparts rotation to the drill bit 104 by rotating the drillstring 40 and downhole assembly 100, and the rotary control 60 typically controls the drillstring's rotational speed.

In addition, a drilling fluid system 65 circulates drilling fluid or "mud" from the surface downward through the drillstring 40. The mud exits through the drill bit 104 and then returns cuttings to the surface via the annulus. If the downhole assembly 100 has a motor (not shown), such as a "mud" motor, then motor rotation imparts rotation to the drill bit 104 through a shaft. The motor may have a bent sub, which can be used to direct the trajectory of the advancing borehole 10.

Figure 2A:
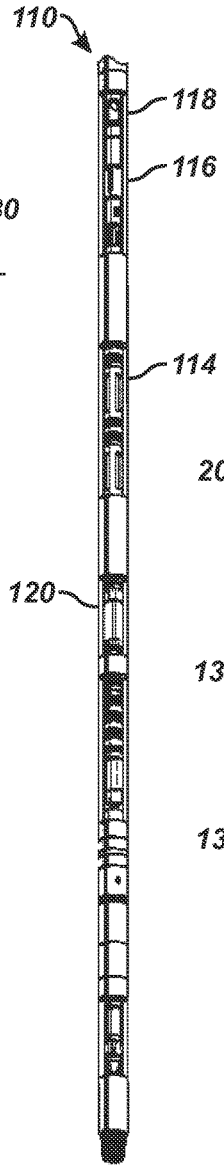
FIGS. 2A-2B illustrate a downhole assembly for the system in more detail.
Figure 2B:
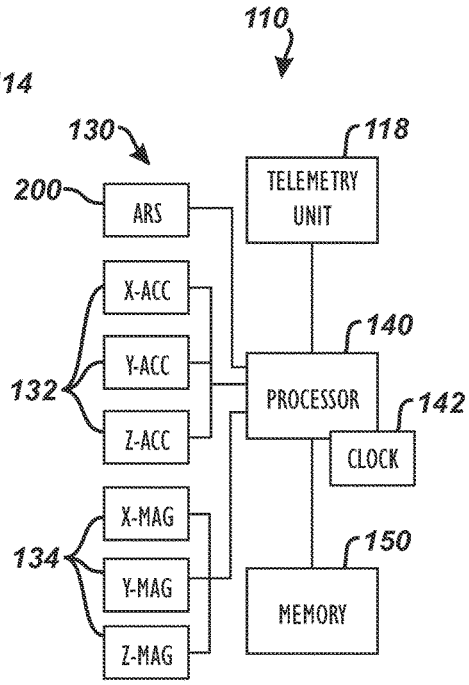

FIGS. 2A-2B show the monitoring tool 110 of the downhole assembly 100 in more detail. The tool 110 has a sensor section 120, a power section 114, an electronics section 116, and a telemetry section 118. The sensor section 120 has sensor elements 130, which can include accelerometers 132 and magnetometers 134 to indicate the orientation (azimuth, inclination, and toolface) of the downhole assembly 100 within the borehole 10. The sensor section 120 can also have other sensors used in Measurement-While-Drilling (MWD) and Logging-While-Drilling (LWD) operations including, but not limited to, sensors responsive to gamma radiation, neutron radiation, and electromagnetic fields.

The electronics section 116 houses electronic circuitry to operate and control other elements within the downhole assembly 100 and includes memory 150 for storing operational parameters and measurements made by the sensor section 120. The electronics section 116 also includes processing circuitry (i.e., one or more processors) 140 to process various measurement and telemetry data. The telemetry section 118 communicates data with the surface by receiving and transmitting data to an uphole telemetry section (not shown) in the surface equipment 30. Various types of borehole telemetry systems are applicable including mud pulse systems, mud siren systems, electromagnetic systems, and acoustic systems. The power section 114 supplies electrical power needed to operate the other elements within the downhole assembly 100.

During drilling, the monitoring tool 110 monitors the orientation of the downhole assembly 100 in the borehole 10. To monitor the orientation, the tool 110 uses the directional sensor elements 130 (with accelerometers 132 and magnetometers 134 arranged on two or more axes) so the sensor elements 130 can provide directional information and the like during drilling. As is known, a magnetometer 134 is a fluxgate induction device whose output indicates its orientation with respect to the earth's magnetic field. Accordingly, the magnetometers 134 can be used to calculate the azimuth and magnetic toolface of the tool 110. "Azimuth" refers to an angle in a horizontal plane measured relative to (true or magnetic) north. Magnetic toolface is typically measured clockwise from the reference north bearing, beginning at 0° and continuing through 360°.

The monitoring tool 110 can also have the accelerometers 132 arranged orthogonally and directly coupled to the insert in the tool 110. The accelerometers 132 are intended to measure acceleration forces acting on the tool 110. The accelerometers 132 can detect inclination of the tool 100 and can also detect vibration and shock experienced by the drillstring 40 downhole.

The tool 110 is programmable at the well site so that it can be set with real-time triggers, parameters, thresholds, values, and the like that indicate when the tool 110 is to transmit data to the surface, to operate in a certain way, to record data, or to perform any other relevant operation or task. The tool's memory 150 and processor 140 can process raw data downhole. In turn, the processor 140 can transmit processed data to the surface using the telemetry system 118. Alternatively, the tool 110 can transmit raw data to the surface where processing can be accomplished using the surface equipment 30 (FIG. 1). The tool 110 can also record data in memory 150 for later analysis.

During drilling, the monitoring tool 110 also monitors the rotation (i.e., revolutions-per-minute (RPM)) of the downhole assembly 100 (collar 106, stabilizers 102, drill bit 104, monitoring tool 110, etc.) on the drillstring 40. To monitor the RPM, the tool 110 can use the directional sensor elements 130 (e.g., accelerometers 132 and magnetometers 134). However, the sensor elements 130 preferably include one or more angular rate sensors 200 that can detected variations in the rotary speed downhole at the drilling assembly 100. The one or more angular rate sensors 200 can be sensitive to angular rotation about one or more axes, but preferably about the longitudinal axis of the tool 110 and downhole assembly 100.

More particularly, at least one angular rate sensor 200 of the tool 110 can be used for communication with the surface by detecting variations in rotational speed downhole. In this way, the drilling system 20 of the present disclosure can effectively downlink useful information from the surface to downhole components of the drilling assembly 100 using the angular rate sensor 200 and processing as discussed below. Examples of the useful information for downlink include incremental depth or real-time depth information, which can be communicated from the surface, detected by the angular rate sensor 200, and used for various purposes.

As one example, incremental or real-time depth information can be used for directional drilling purposes. During directional drilling, operators typically attempt to vary or control the direction of the borehole 10 as it is being drilled. At least one goal during directional drilling is to reach or maintain a particular position within a target subterranean area using known directional information. By using a directional drilling tool 108 (e.g., a mud motor with a bent sub, a rotary steerable tool, a targeted bit speed tool (TBS), etc.) on the drilling assembly 100, for example, operators are capable of having some control of the drilling direction by knowing the angle of inclination of the drill bit 104 and the azimuthal position obtained from directional sensor elements 130.

The angle of inclination and the azimuthal position of the drill bit 104 can be determined from the local sensors (e.g., accelerometers 132 and magnetometers 134). Although absolute depth can be communicated periodically from the surface using the telemetry system 118 and conventional telemetry techniques, the incremental depth of the drill bit 104 is typically not known by the directional drilling tool 108 downhole. By knowing the incremental depth of the drill bit 104, however, the directional drilling tool 108 may be utilized to drill the borehole 10 in autopilot mode (i.e., having minimal or no intervention from the surface). This incremental depth information, along with the angle of inclination and the azimuth, can further be used to calculate the position of the downhole assembly 100 in three dimension by using the true vertical depth (TVD), and Easting/Northing parameters so the downhole assembly 100 can be more accurately directed.

As another example, incremental depth information can also be used to correct or minimize porpoising effects caused while drilling the borehole 10. Porpoising effects are typically related to over-correcting or under-correcting of the direction of the drillbit 104 as the drillbit 104 changes position within a particular subterranean strata or zone. Thus, by knowing the incremental depth of the drillbit 104, as well as the ROP, the position and trajectory of the drillbit 104 may be more accurately ascertained. As a result of having increased accuracy of the drillbit depth and ROP, any over-correction or under-correction of the trajectory of the drillbit 104 may be minimized.

As yet another example, another benefit of knowing the incremental depth of the drilling assembly 100 is having the ability to correlate and/or adjust measurements made by the downhole assembly 100. For example, by knowing incremental depth data downhole, the downhole assembly 100 may correlate and/or adjust various measurements made by the monitoring tool 110 and sensors in the assembly 100. For instance, as will be described in detail below, the assembly 100 may align and/or correlate sensor information based on the longitudinal offset of the sensor in the assembly 100.

Downlinking the desired information from the surface to the downhole assembly 100 encodes the information using changes in RPM at the surface in conjunction with changes in depth at the surface. For example, the driller may have set the RPM for drilling the borehole 10 to a particular value (e.g., 100 RPM). As drilling continues, the surface equipment 30 then recognizes that the drillstring 40 has advanced into the hole a certain incremental interval (e.g., a one-foot distance). The surface equipment 30 then signals for the RPM to drop to a lower value (e.g., 95 RPM) as the system 20 drills the following incremental interval (e.g., a second one-foot distance). Then, when the next incremental interval (e.g., the third one-foot distance) is drilled, the surface equipment 30 then signals for the RPM to be adjusted back to its set value (e.g., 100 RPM).

Downhole, the downhole angular rate sensor 200 detects the RPM during drilling, and the processor 140 integrates the RPM to derive average rates. In general, the change in rotational speed implemented at the surface translates to a comparable change in the rotational speed imparted at the downhole assembly 100, given a suitable period of time has elapsed to overcome twisting, friction, torque, etc. along the drillstring 40. The processor 140 then determines that the RPM has changed a predetermined threshold (e.g., 5% or whatever is desired for the present drilling conditions). This determination essentially indicates an incremental interval that the downhole assembly 100 has penetrated. The processor 140 passes this information globally on a downhole communications bus of the monitoring tool 110. All of the other sensor elements 130 needing this depth data can then use it accordingly. For example, this depth data can be used for trajectory control, time-lapsed data correlation, etc. In addition to incremental or real-time depth, other forms of data can be sent using this form of downlink encoding.

Figure 3:
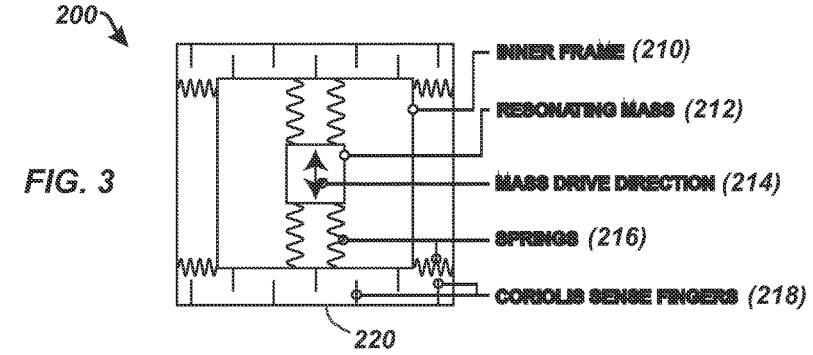
FIG. 3 schematically illustrates a detailed view of an angular rate sensor for the disclosed downhole assembly according to the present disclosure.

As noted above, one of the sensors disposed downhole on the drilling assembly 100 can include an angular rate sensor 200 used to detect changes in the rotational speed of the drilling assembly 100 for downlinking information from the surface equipment 30 to the monitoring tool 110. FIG. 3 schematically illustrates a detailed view of an exemplary angular rate sensor 200 for the disclosed downhole assembly 100 according to the present disclosure. A suitable form of angular rate sensor 200 for use with the disclosed techniques includes an angular rate gyroscope responsive to Coriolis acceleration, and a suitable example is the iMEMS® Angular-Rate-Sensing Gyroscopes available from Analog Devices.

Preferably, the angular rate sensor 200 for the present disclosure is immune to magnetic fields and linear acceleration and can be sufficiently accurate at low angular rates, even less than 1 RPM. Thus, the angular rate sensor 200 is not susceptible to changes in inclination or magnetic fields. In the end, the sensor 200 is capable of accurately measuring slight variations in rotational speed while in the presence of vibrational shocks, magnetic fields, and other environmental conditions, and may be capable of other functions suitable for downhole use to detect RPM changes.

The angular rate sensor 200 measures the angular rate of an object on which the sensor is mounted (i.e., a housing 112 or the like on the tool 110). In this way, the angular rate sensor 200 measures how quickly the drilling assembly 100 rotates while drilling. For instance, as the sensor 200 turns, it outputs a voltage proportional to the angular rate (e.g., mV/degree/second). To measure the angular rate, the sensor 200 uses Coriolis acceleration, which is the rate of increase of a mass' tangential speed caused by the mass' radial velocity.

Being an angular rate gyroscope, the angular rate sensor 200 has a resonating mass 212 that takes advantage of the Coriolis Effect. The resonating mass 212 can be micromachined polysilicon tethered to a polysilicon frame (inner frame) by springs 216 so that the resonating mass 212 resonates in only one direction. The inner frame 210 containing the resonating mass 212 is tethered to a substrate by springs 216 perpendicular to the resonating motion of the resonating mass 212. Coriolis sense fingers 218 capacitively sense displacement of the inner frame 210 in response to the forces exerted by the resonating mass 212 during the movement from reaction forces.

Figure 4A:
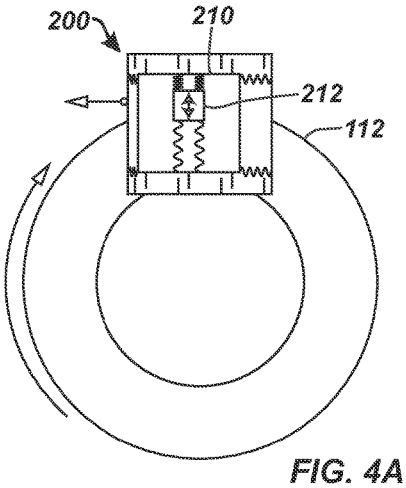
FIGS. 4A-4B illustrates how the angular rate sensor in FIG. 3 is responsive to changes in RPM relative to the downhole assembly.
Figure 4B:
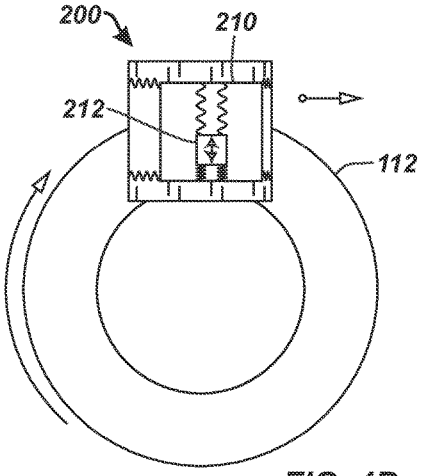

As shown in an exaggerated view in FIG. 4A, the angular rate sensor 200 with the resonating mass 212 and inner frame 210 mounts on a housing 112 or other body of the drilling assembly 100. When the resonating mass 212 moves towards the outer edge of the angular rate sensor 200 as it rotates, the resonating mass 212 is accelerated to the right and exerts a reaction force on the inner frame 210 in the opposite (i.e., left) direction as indicated by the arrow. In contrast, when the resonating mass 212 moves inward from the outer edge as it rotates, the reaction force is exerted on the inner frame 210 to the right as indicated by the arrow in FIG. 4B.

Advantageously, the angular rate sensor 200 is immune to shock and vibration, and experimentation has verified this when disposed on a drill collar and rotated at higher RPMs. As is known, the drilling environment creates a great deal of shock and vibration that can make measurements replete with noise and sometime useless. The angular rate sensor 200, however, does not sense changes to linear forces so it only measures angular rate. This is an advantage over typical accelerometers, which are very susceptible to vibration. In the end, being able to measure angular rate of the drilling assembly 100 with the disclosed angular rate sensor 200 without interference from shock and vibration is, therefore, particularly useful in determining changes in the rotation of the drilling assembly 100 for communicating data, such as incremental depth.

As noted previously, downlinking incremental depth information or other data according to the present disclosure not only involves changing the rotational speed during drilling and detecting those changes, but also involves making those changes at particular depth intervals on a consistent basis. Therefore, depth measurements are made by the surface equipment 30 so the rotational speed can be changed at the desired depth intervals. Preferably, the depth intervals involved according to the present disclosure can be less than 30-ft increments, which is the typical extent of stands of the drilling string 40. Focusing on finer intervals less than 30-ft can have a number of benefits in measurement resolution, control, and the like.

Figure 5:
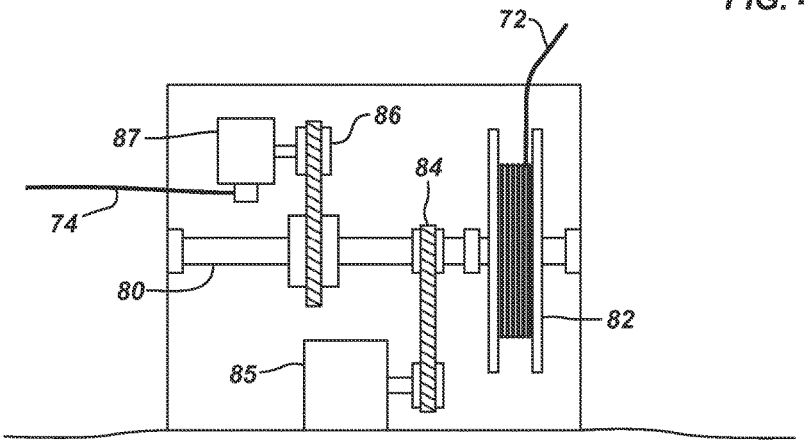
FIG. 5 illustrates a schematic view of a drawworks system having an encoder.

One way to make the depth measurements at the surface with the surface equipment 30 uses the drawworks control 70 of the drilling system 20. For example, the drawworks control 70 as shown in FIG. 5 has a drawworks encoder 87 disposed therein. During use, a drawworks motor 85 coupled by a drive connection 84 (belt, gear, etc.) turns a shaft 80 inside the drawworks control 70. The drawworks motor 85 may turn the shaft 80 clockwise or counter-clockwise, depending on whether the drawworks control 70 will release or retract cable 72 from a spool 82, which serves to either raise or lower the traveling block (54; FIG. 1) of the downhole system 20. For instance, if the motor 85 turns the shaft 80 one direction, the cable spool 82 will be unwound, and the cable 72 will be released to the crown block (56) of the derrick structure (58), thereby lowering the crown block (56) and drillstring (40) into the borehole (10). However, if the motor 85 is turned in the opposite direction, the same process will occur except the crown block (56) and drillstring (40) will be raised.

To keep track of the displacement of the cable 72 from the cable spool 82, the encoder 87 is coupled by a drive connection 86 (belt, gear, etc.) and is driven by the main shaft 80 of the drawworks control 70. In this way, the encoder 87 counts the amount of cable 72 released from or retracted to the cable spool 82. By knowing the amount of cable 72 released in this manner, it is possible to determine the distance the drillstring (40) has progressed into the borehole (10). The output line 74 of the drawworks control 70 can be used to communicate the distance information determined at the drawworks encoder 87 to the surface equipment (30). The drawworks control depicted in FIG. 5 merely represents one type of system that may be used to release cable 72 and measure the amount of cable 72 released. As will be appreciated, other types of systems could be used.

Now that structural components for downlinking incremental depth data have been described, discussion now turns to a process for performing the downlink. In general, the process can be described as configuring surface equipment 30 to change the rotation of the downhole assembly 100 at certain depth interval(s). At least one predetermined depth interval may be configured at the surface equipment 30 and monitoring tool 110. However, it is possible to use multiple depth intervals to communicate different forms information at the same time. For example, every first, second, third, and fourth interval (e.g., each foot distance) can be used to communication one form of information based on changes in rotational speed, while every fifth internal (e.g., each five foot distance) can be used to also communication another form of information based on changes in rotational speed.

Meanwhile, downhole processing equipment in the monitoring tool 110 configured with the same depth interval(s) measures the change in rotation downhole using the angular rate sensor 200 and correlates the change in rotation to the change in depth. Once the change in depth is known downhole, the processing equipment can use the determined depth along with measurements from other downhole sensors to determine the ROP of the drilling assembly 100 as well as other useful information.

Figure 6:
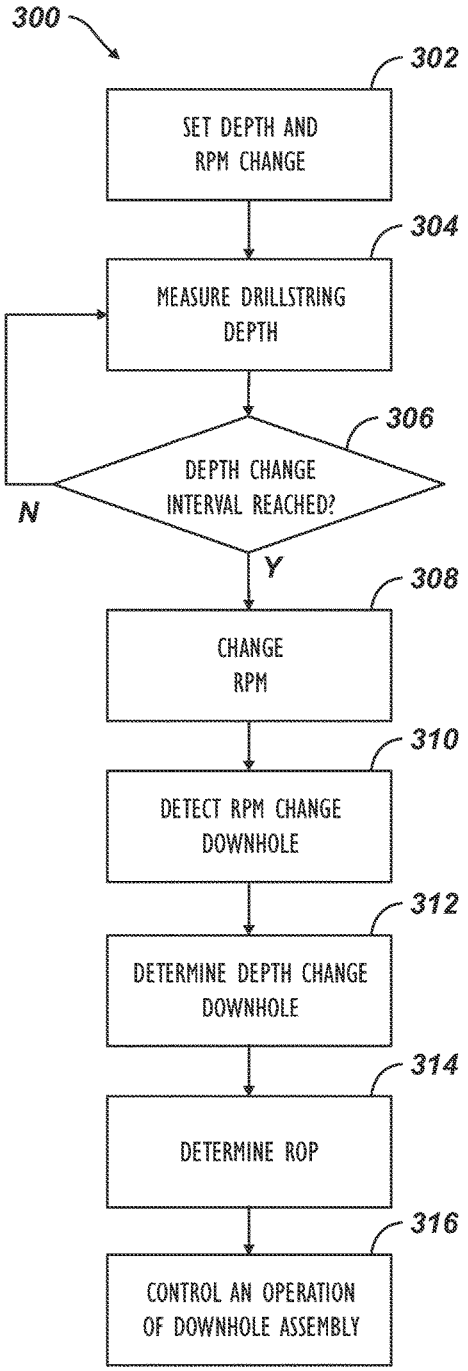
FIG. 6 illustrates a process of communicating incremental depth data downhole according to the present disclosure.

FIG. 6 illustrates a process 300 of communicating incremental depth data according to the present disclosure. Referring concurrently back to FIG. 1, a predetermined change in the rate of rotation and predetermined depth change are set at the surface (Block 302). These predetermined factors enable the surface equipment 30 to change rotational speed of the drilling system 20 in a predetermined way per change in depth. The predetermined change in the rotational speed and the predetermined depth change are also set in the processing equipment 140 and memory 150 of the monitoring tool 110 to correlate depth information from a detected change in rotational speed downhole from the angular rate sensor 200.

The predetermined change in rate of rotation and the predetermined depth change may be set in the monitoring tool 110 at surface before deployment or between redeployment. However, assuming that two way communication exists between the monitoring tool 110 and the surface equipment 30, the predetermined information or other data may be telemetered downhole using known telemetry techniques and/or using the downlinking techniques of the present disclosure. Accordingly, the drilling system 20 can use conventional telemetry to communicate other data for the downhole assembly 100 downhole from the surface equipment 30 to the monitoring tool 110 or uphole from the tool 110 to the surface equipment 30. For example, the surface equipment 30 can telemeter instructions and new, changed, or updated depth intervals downhole for the monitoring tool 110 to store in memory 150.

Once drilling has commenced, the actual change in the drilled depth of the drillstring 40 is measured (Block 304). As previously described, the drawworks encoder 87 within the drawworks control 70 may be used to measure how many feet of cable 72 has been released. As a result, the amount of cable 72 released from the cable spool 82 can be used to determine the increments of depth the drillstring 40 has penetrated into the borehole 10. Using the output line 74 of the drawworks control 70, the incremental depth data may be sent to the surface equipment 30, where the incremental depth data may be compared with the predetermined depth change of the drillstring 40, as described above.

Accordingly, the actual change in the drilled depth and the predetermined depth change of the drillstring 40 is then compared (Block 306). This comparison may be performed at a surface processor in the surface equipment 30 or elsewhere. If the actual change in the drilled depth is not at least as much as the predetermined depth change of the drillstring 40, previous processing may be repeated (Block 304 and 306).

However, if the comparison is satisfied (i.e., the actual depth change of the drillstring 40 is at least as much as the predetermined depth change), then the surface equipment 30 changes the rotation (i.e., RPM) of the drilling assembly 50 so that the change can be detected downhole with the monitoring tool 100 (Block 308). For example, the surface equipment 30 may use the rotary table 52 to change the rotational speed of the drillstring 40, although the rate change of the drillstring 40 may be controlled via flow rate using a mud motor, a downhole generator, a turbine, and/or an impeller or any other such rotational drive mechanism. For instance, the surface equipment 30 may use the rotary control 60 to automatically change the RPM of the rotary table 52, thereby changing the RPM of the downhole assembly 100. The change in RPM of the rotary table 52 may also be implemented manually, having an operator invoke the change at the surface.

Once the rotational speed of the drillstring 40 has been changed, the angular rate sensor 200 detects the change downhole (Block 310). Preferably, the angular rate sensor 200 of the downhole assembly 100 is a gyroscope as disclosed above. Due to the acute measurement sensitivity of the angular rate sensor 200, only minor variations in the rotational speed may be necessary (e.g., ±2.5%) to impart the change for detection downhole by the monitoring tool 110, and no absolute change of the rotational speed may be required for detection. However, the angular rate sensor 200 of the downhole assembly 100 may also be an X-Y magnetometer or other such device used for measuring changes in angular speed.

As the sensor 200 detects the rotational speed/angular rate, electronics, circuitry, and the like of the downhole tool 110 communicatively connected to the angular rate sensor 200 then averages the changes in rotational speed. For example, the processor 140 can average even a wildly varying RPM (stick slip conditions) to produce a very stable measurement that could easily discern a ±2.5 change in RPM.

Each noted change in rotational speed is then correlated to the predetermined depth interval stored in memory 150 so the monitoring tool 110 can determine a depth change of the downhole assembly 100 (Block 312). For example, having a predetermined depth interval of say one-foot, each detected change in rotational speed determined by the monitoring tool 100 equates to an additional increment in depth of the downhole assembly 100. In this way, determining a depth for the downhole assembly can involve multiplying a count of the detected changes by the predetermined depth interval. Overall, the processing equipment 140 can determine a depth value of the downhole assembly 100, which can be used for a number of useful purposes.

The time between detected rotational changes can also be determined so the rate of penetration (ROP) of the downhole assembly 100 can be determined (Block 314). For example, the processing equipment of the monitoring tool 110 may include a clock device 142, as shown in FIG. 2B. By knowing the time between the detected changes, the monitoring tool 110 can determine the change in depth of the drillstring 40 and downhole assembly 100.

After receiving a signal from the angular rate sensor 200 representing a detected change in angular velocity, the processor 140 uses the clock device 142 to record the time. Subsequently, at the time the processor 140 receives another signal from the angular rate sensor 200 representing another change in angular rate, the processor 140 records that time, and determines the change in time between the changes in RPM. Alternatively, the processor 140 may record the time of a change in rotational speed and compare that time to a cumulative time since drilling commenced, in the case of an initial engagement of the downhole assembly 100, or after drilling has been recommenced.

Either way, the processor 140 may use the change in time between measurements along with the known predetermined change in depth to calculate the rate of penetration (ROP) of the downhole assembly 100. For example, the equation for calculating ROP can be characterized as:

$$\text{Rate of Penetration (ROP)}=(\Delta\text{Depth})/(\Delta\text{Time between RPM changes}).$$

After the processor 140 determines a depth valve and/or calculates the ROP, the processor 140 may make this depth information available for other sensor elements 130, measurements, and the like for the downhole assembly 100 to use according to their purposes so an operation of the downhole assembly 100 can be controlled (Block 316). Communication between components of the monitoring tool 110 may use the broadcast of data with telemetric techniques known in the art, or data may be shared using a wired bus integrated into the drilling assembly 100. Furthermore, for a form of closed loop-feedback, the monitoring tool 110 may communicate information back to the surface using known telemetry methods such as mud pulse, electromagnetic EM telemetry, etc. This telemetered information can be used for corrective action, altering drilling parameters at surface, or any other desired purpose.

After the incremental depth has been determined downhole using the techniques described above, the predetermined change in the rate of rotation and predetermined depth change may be reset at the surface and synchronized to the downhole sensor elements 130, forming an ROP contract between the surface and downhole sensor elements 130. This contract (i.e., synchronization between the surface equipment 30 and the downhole sensors 130) may be established using known communication techniques (e.g. pressure, electromagnetic EM, or other telemetry). This will allow the incremental depth information to be modified relative to the ROP. For example, if the ROP of the drilling assembly 100 is very high, there may not be a need for each foot of incremental depth information to be communicated. Instead, in very high ROPs the predetermined depth change may be set to a larger depth (e.g., 10 feet) so that the RPM is changed at the surface every 10 feet instead of a shorter change rate.

Likewise if the ROP is slower, due to having to penetrate through denser structures downhole, the incremental depth data may need to be communicated in smaller increments, (i.e., the predetermined depth change may need to be in smaller increments). For similar reasons, the predetermined rate of the change in rotation speed of the drillstring 40 may need to be modified (e.g., if a 5% change in RPM is not sufficient for being detected downhole, or if the current change rate is not necessary).

Although the above is an illustration of the process, the predetermined change in the rate of rotation and predetermined depth change may be modified at any time during operations.

As described above, not knowing the incremental depth that the drilling assembly 100 has penetrated makes it impossible to determine the ROP in real-time at the downhole assembly 100. With the above process, however, the monitoring tool 110 is able to obtain this information and update the sampling or measurement rate based on the ROP, potentially saving both power and memory capacity.

Figure 7:
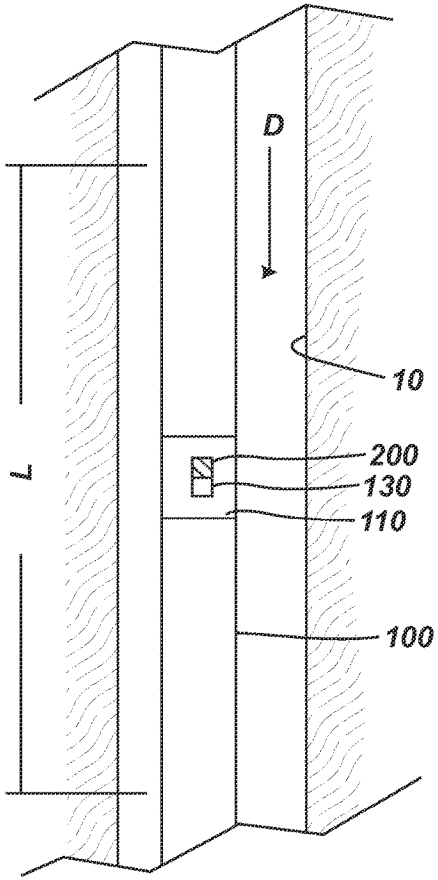
FIG. 7 illustrates an arrangement of sensors on a downhole assembly disposed in a wellbore according to the present disclosure.

FIG. 7 illustrates portion of a downhole assembly 100 disposed in a borehole 10 during drilling. The assembly 100 has the monitoring tool 110 according to the present disclosure. The tool 110 may measure a plurality of geophysical properties using various sensor elements 130 and using acoustics, electromagnetics, or other methods. Further, as described above, the tool 110 may contain an angular rate sensor 200 for measuring a change in RPM of the drilling assembly 100. The downhole sensor 200 may either be integrated in a controller for analyzing data and broadcasting data to other controllers or sensors downhole, or the sensor 200 may be standalone.

As discussed previously, the downhole sensor 200 disposed within the drilling assembly 100 measures data within the borehole 10 as the drilling assembly 100 penetrates the formation. As the assembly 100 penetrates the formation downhole, the sensor 200 moves in a direction (D) through the advancing borehole 10 along a particular length or internal (L) of the borehole 10.

Using the process of FIG. 6, the monitoring tool 110 is able to determine the incremental depth data of the downhole assembly 100 and to calculate the current ROP. As described above, this information may be made available to the other components and other sensor elements 130 of the downhole assembly 100. Based on the data, the components and other sensor elements 130 may update their sampling rates accordingly. For example, the tool 110 and sensor elements 130 may have been originally transacted to perform measurements or to sample data twice every foot given a predetermined ROP. If the ROP calculated by the tool 110 has decreased substantially, then the sensor elements 130 may update their measurement points so that they continue to only take two measurements per drilled foot. Likewise, if the ROP increases, the sensor elements 130 can update sampling rates to more rapidly take measurement so not to miss necessary sampling downhole. As will be appreciated to those skilled in the art, this aspect of the disclosure will help to optimize memory and energy usage downhole.

Figure 8:
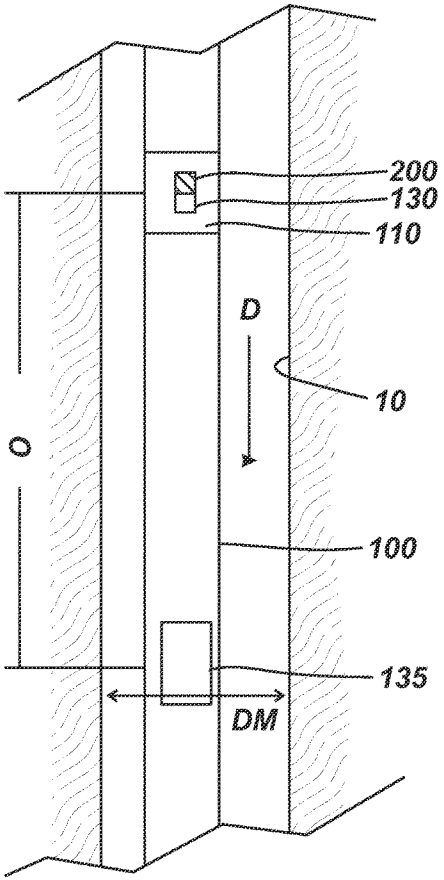
FIG. 8 illustrates another arrangement of sensors on a downhole assembly disposed in a wellbore according to the present disclosure.

FIG. 8 illustrates multiple downhole sensors 130, 135, 200 disposed on a drilling assembly 100 according to the present disclosure. By knowing the incremental depth data downhole, the relative distance moved may be ascertained downhole. In one illustration, it may be useful to correlate and/or adjust measurements based on the incremental depth data by aligning downhole sensor information based on the longitudinal offset of the downhole sensors 130, 135, and 200 in the downhole assembly 100.

For example, the downhole sensor 200 and sensor elements 130 are disposed on the monitoring tool 110 of the drilling assembly 100 as before, while a caliper sensor 135 is also disposed on the drilling assembly 100 at an offset (0) from the other sensors 130, 200. As an example, the caliper sensor 135 may be offset 10-feet or so in advance of the downhole sensor 200 along the drilling assembly 100.

As the drilling assembly 100 penetrates the borehole 10, the sensors 130, 135, 200 move in direction (D) and are configured to take measurements. In one illustration, using the process of FIG. 6, the caliper sensor 135 may obtain the incremental depth data of the drilling assembly 100 form the angular rate sensor 200. The caliper sensor 135 can then subsequently store information about the borehole diameter (DM) for every depth interval.

During drilling, the sensor elements 130 collect measurement data of the surrounding borehole, however the sensor elements 130 may be a type of sensor that is greatly affected by the diameter (D) of the borehole 10. Therefore, before taking measurements, the sensor elements 130 can request the borehole diameter (DM) from the caliper sensor 135. Because incremental depth is known downhole at the tool 110 from previous processing, the diameter data recorded by the caliper sensor 135 provided to the sensor elements 130 may be the diameter the sensor 135 recorded at the offset O earlier.

Figure 9:
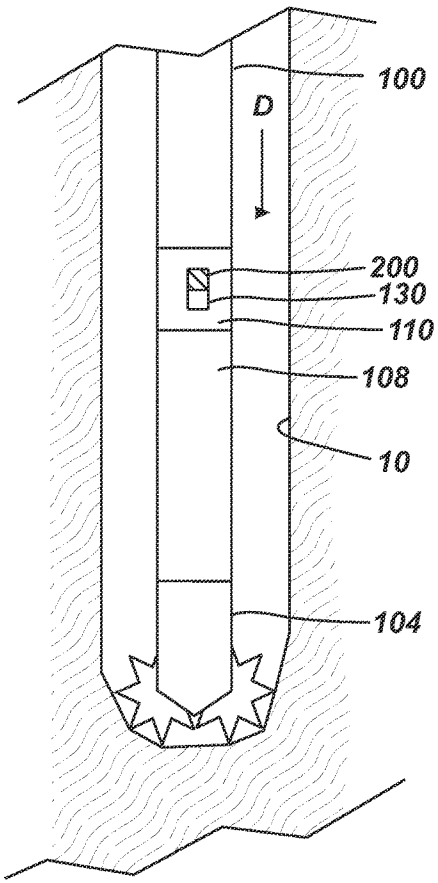
FIG. 9 illustrates a direction drilling tool on a downhole assembly disposed in a wellbore according to the present disclosure.

Referring now to FIG. 9, the downhole assembly 100 is shown having a directional drilling tool 108 in the borehole 10. In this illustration, the incremental depth data may be communicated according to the presently disclosed process in FIG. 6, along with periodic communications of the depth measured at the surface to determine the absolute depth downhole. As shown, the monitoring tool 110 has a downhole sensor 200 used in measuring the incremental depth information as described above and includes other sensor elements 130 to measure orientation of the assembly 100. As the directional drilling tool 108 steers the drill bit 104 for penetrating the downhole formation, communication of the incremental depth information along with the periodic depth measurement from the surface can be used to guide the directional drilling tool 108 and maintain a proper drilling trajectory for reaching a predetermined subterranean target with minimal intervention from the surface.

Further, alternately or in addition to information stored downhole, because pumps are cycled every time a new length of pipe is added to the drillstring 40, the pump-cycle count could be stored and used to measure and correlate the depth of the drilling assembly 100. Pressure sensors in the sensor elements 130 downhole can recognize the pump cycle condition and can be used to transfer the pump-cycle count to the surface equipment via mudpulse or some other telemetry. The surface equipment 30 may then associate a depth with the pump-cycle count, and the recorded incremental data in the system 20 may be aligned with the pump-cycle count depth information. This illustrative validation process may prove useful even if the clock devices 142 downhole fail.

Although incremental or real-time depth information is downlinked in the present description, other types of data and information for with the downhole assembly 100 may be communicated downhole from the surface equipment 30 to the monitoring tool 110 using the disclosed downlinking techniques. In another embodiment of the present disclosure, for example, it is possible to communicate data other than incremental depth data to the monitoring tool 110 downhole. In this embodiment, it may not be necessary to measure the incremental depth of the drilling assembly 100 or measure the changes in rotational speed of the assembly 100. As described above, changes in the rotational speed of the assembly 100 may be detected and correlated as data downhole. However, using the techniques disclosed herein, other changes in the system 20 may be detected and likewise correlated as useful data, thereby communicating useful data to the monitoring tool 110 downhole while not needing to encode or otherwise packetize the data.

In one example, changes in the drilling system 20 may be related to detecting pressure pulses generated using mud pulse telemetry, detecting EM pulses, detecting phase and/or amplitude shifts in EM signals, and/or detecting sonic pulses in an acoustic telemetry system or otherwise.

Figure 10:
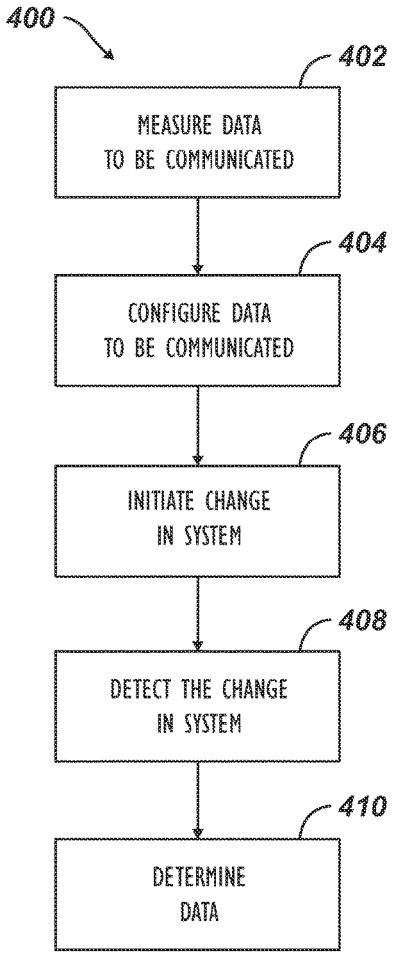
FIG. 10 illustrates a process of communicating data downhole by detecting changes in the system according to the present disclosure.

Referring now to FIG. 10, a process 400 can be used for downlinking data downhole by initiating changes in the system 20 at surface and then detecting those changes in the system 20 downhole with a monitoring tool 110. The initiated changes in the system 20 can include operational changes of the system 20. As noted previously, one of those operational changes can be a change in the rotational speed imparted to the downhole assembly 100 and made at predetermined depth intervals. Any other operational parameters of the system 20 can be changed, such as pump rate, weight on bit, etc. The change can be imparted to the downhole assembly 100 and made at predetermined intervals of time, depth, location, preset tool function, etc.

According to the process 400, the data is first measured (Block 402). The data may be either measured at the surface and/or measured downhole and calculated at the surface. Also, the data may be any data relevant to the functionality of the downhole assembly 100 such as time data, location and/or depth information, tool functionality, etc.

The data to be communicated downhole may be configured at the surface using the surface equipment 30 (Block 404). Configuring the data may include setting or establishing a contract between the surface equipment 30 and downhole processors 140, sensor elements 130, etc. for associating the data to be communicated with a change in the system 20. Further, because this illustration is not necessarily related to detecting RPM changes in the system 20, the surface equipment 30 may or may not necessarily use the surface rotary control 60.

Once the data to be communicated has been measured and configured to be communicated downhole, a change in the system 20 is initiated (Block 406). As discussed above, such changes in the system 20 may include generating pressure pulses using mud pulse telemetry, generating EM pulses, generating phase and/or amplitude shifts in EM signals, and/or generating sonic pulses in an acoustic telemetry system or otherwise. Thereafter, once a change in the system 20 has been initiated (e.g., a pressure pulse in the drilling fluid has been generated at the surface), the change in the system 20 is detected downhole (Block 408).

Depending on the method of telemetry used, however, different sensors 130, 200 on the monitoring tool 110 may be used for detecting changes in the system 20. According to the present disclosure, however, receivers and/or sensors of the tool 110 may include receivers, sensors, transducers, or any other device used to detect changes in the drilling system 20. For example, in the above example, pressure transducers may be used downhole for detecting pressure changes in the system 20 instead of an angular rate sensor 200 being deployed downhole, although both may be used. Likewise, acoustic and/or EM receivers may be deployed downhole for detecting system changes due to acoustic and/or EM telemetry.

Once the change in the system 20 has been detected, the change in the system 20 may be determined or otherwise correlated with the data that was to be communicated (Block 408). That is, the monitoring tool 110 may detect the change in the system 20 and then correlate that change to the data communicated from the surface. As a result, because the data or information configured to be communicated is associated with the change in the system 20, and not encoded and/or packetized, the data may be quickly correlated and understood by the monitoring tool 110 for use. As a result of this method of data association, instead of the issues related to telemetry by data encoding, data may be communicated downhole while drilling operations remain virtually unaffected.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof

What is claimed is:

1. A method of drilling a borehole with a downhole assembly, the method comprising:

storing in the downhole assembly at least one predetermined change in rotational rate correlated to at least one predetermined depth interval;

drilling the borehole with the downhole assembly while successively measuring each of the at least one predetermined depth interval at the surface;

successively detecting, using an angular rate sensor of the downhole assembly, changes from different rotational rates, each of the successively detected changes imparted to the downhole assembly from the surface at each of the at least one predetermined depth interval successively measured at the surface;

determining, using processing circuitry of the downhole assembly, a downhole depth value for the downhole assembly by counting each of the successively detected changes; and controlling an operation of the downhole assembly based on the determined depth value.

2. The method of claim 1, wherein detecting, using the angular rate sensor of the downhole assembly, the changes from the different rotational rates imparted to the downhole assembly comprises integrating the detected rotational rates as averages and determining differences in the averages at least above a threshold.

3. The method of claim 1, wherein determining, using the processing circuitry of the downhole assembly, the downhole depth value for the downhole assembly by counting each of the successively detected changes comprises multiplying a count of the successively detected changes by the at least one predetermined depth interval.

4. The method of claim 1, further comprising:

measuring, using the processing circuitry, a time interval between the detected changes; and determining, using the processing circuitry, a rate of penetration for the downhole assembly based on the downhole depth value and the measured time interval.

5. The method of claim 1, wherein controlling the operation of the downhole assembly based on the determined depth value comprises configuring a sensing parameter of at least one sensor element of the drilling assembly based on the determined depth value.

6. The method of claim 1, wherein controlling the operation of the downhole assembly based on the determined depth value comprises controlling an operational parameter of a directional drilling component of the downhole assembly.

7. The method of claim 1, further comprising obtaining at the downhole assembly an updated one of the at least one predetermined depth interval for storage;

and detecting and determining based on the updated depth interval.

8. The method of claim 7, wherein obtaining at the downhole assembly the updated predetermined depth interval comprises detecting the updated predetermined depth interval via telemetry.

9. The method of claim 1, wherein drilling the borehole with the downhole assembly while successively measuring each of the at least one predetermined depth interval at the surface comprises:

advancing the downhole assembly in the borehole, measuring with the surface equipment successive ones of the at least one predetermined depth interval, and alternatingly imparting rotation to the downhole assembly with the at least one predetermined change in rotational rate for each of the successive ones of the at least one predetermined depth interval.

10. The method of claim 9, wherein measuring with the surface equipment the successive ones of the at least one predetermined depth interval comprises measuring with a drawworks encoder.

11. The method of claim 9, wherein imparting the rotation to the downhole assembly comprises imparting the rotation with one or more of a rotary table, a mud system, a mud motor, a downhole generator, a turbine, and an impeller.

12. The method of claim 9, wherein alternatingly imparting the rotation to the downhole assembly with the different rotational rates for the successive ones of the at least one predetermined depth interval comprises alternating the rotation between a first rotational rate and a second rotational rate within a percentage of the first rotational rate.

13. The method of claim 1, wherein storing in the downhole assembly the at least one predetermined change in rotational rate correlated to the at least one predetermined depth interval comprises setting, at the surface and in the downhole assembly, the at least one predetermined change in rotational rate correlated to the at least one predetermined depth interval.

14. The method of claim 13, further comprising:

advancing the downhole assembly downhole in the borehole while measuring the depth at the surface; and imparting, from the surface, the at least one predetermined change in rotational rate to the downhole assembly at the at least one predetermined depth interval from the depth measured at the surface, wherein detecting, using the angular rate sensor of the downhole assembly, the changes from the different rotational rates imparted to the downhole assembly comprises detecting, using the angular rate sensor of the downhole assembly, the at least one predetermined change in rotational rate imparted to the downhole assembly while drilling the borehole.

15. An assembly for drilling a borehole, comprising:

a drilling component disposed on the assembly and drilling the borehole with rotation;

first storage disposed on the assembly and storing at least one predetermined change in rotational rate correlated to at least one predetermined depth interval;

an angular rate sensor disposed on the assembly and detecting the rotation; and first processing circuitry disposed on the assembly and operatively coupled to the first storage and the angular rate sensor, the first processing circuitry counting a downhole depth value of the downhole assembly from successive changes detected in the rotation of the downhole assembly corresponding to the at least one predetermined change in rotational rate correlated to the at least one predetermined depth interval stored in the storage, the successive changes imparted to the downhole assembly from the surface at each of the at least one predetermined depth interval successively measured at the surface.

16. The assembly of claim 15, wherein the drilling component comprises a drill collar having a drill bit disposed thereon.

17. The assembly of claim 15, wherein the drilling component comprises a drilling motor having a drill bit disposed thereon.

18. The assembly of claim 15, wherein the drilling component comprises a directional drilling tool; and wherein the first processing circuitry controls an operational parameter of the directional drilling tool based on the determined depth valve.

19. The assembly of claim 15, wherein the first processing circuitry measures a time interval between the detected changes and determines a rate of penetration for the downhole assembly based on the downhole depth value and the measured time interval.

20. The assembly of claim 15, wherein the angular rate sensor comprises one or more of an angular rate gyroscope responsive to Coriolis acceleration, an accelerometer, and a magnetometer.

21. The assembly of claim 15, further comprising at least one sensor element disposed on the downhole assembly and operatively coupled to the first processing circuitry, the first processing circuitry configuring a sensing parameter of the at least one sensor element based on the determined depth valve.

22. The assembly of claim 15, further comprising:

second storage at the surface storing the at least one predetermined change in the rotational rate correlated to the at least one predetermined depth interval;

a drive imparting rotation to the downhole assembly to drill the borehole;

surface equipment advancing the downhole assembly in the borehole and measuring successive ones of the at least one predetermined depth interval; and second processing circuitry operatively coupled to the second storage, the drive, and the surface equipment, the second processing circuitry alternatingly imparting the rotation to the downhole assembly with the at least one predetermined change in rotational rate for the successive ones of the at least one predetermined depth interval.

23. The assembly of claim 22, wherein the surface equipment comprises a drawworks encoder measuring the advancement of the downhole assembly.

24. The assembly of claim 22, wherein the drive comprises one or more of a rotary table, a mud system, a mud motor, a downhole generator, a turbine, and an impeller.

25. The assembly of claim 15, further comprising surface equipment deploying the downhole assembly in the borehole and imparting rotation to the downhole assembly, the surface equipment storing the at least one predetermined change in rotational rate correlated to the at least one predetermined depth interval and measuring depth at surface, the surface equipment imparting the at least one predetermined change in rotational rate at the at least one predetermined depth interval from the depth measured with the surface equipment.

* * * * *